US008869476B2

(12) United States Patent
Delavaud et al.

(10) Patent No.: US 8,869,476 B2
(45) Date of Patent: Oct. 28, 2014

(54) SEALING ARRANGEMENT

(75) Inventors: Thibault Collin Delavaud, Subingen (CH); Rachid Annan, Subingen (CH)

(73) Assignee: VSL International AG, Koniz (CH)

( * ) Notice: Subject to any disclaimer, the term of this patent is extended or adjusted under 35 U.S.C. 154(b) by 0 days.

(21) Appl. No.: 13/581,547

(22) PCT Filed: Mar. 26, 2010

(86) PCT No.: PCT/EP2010/053975

§ 371 (c)(1),
(2), (4) Date: Nov. 7, 2012

(87) PCT Pub. No.: WO2011/116828

PCT Pub. Date: Sep. 29, 2011

(65) Prior Publication Data

US 2013/0186019 A1 Jul. 25, 2013

(51) Int. Cl.

| | |
|---|---|
| ***E04C 5/08*** | (2006.01) |
| ***E01D 19/14*** | (2006.01) |
| ***E04C 5/12*** | (2006.01) |
| *E01D 11/00* | (2006.01) |

(52) U.S. Cl.
CPC .. *E04C 5/12* (2013.01); *E01D 19/14* (2013.01)
USPC ..... 52/223.13; 52/223.1; 52/223.14; 14/18; 14/21; 14/22; 14/23

(58) Field of Classification Search
CPC ..... E01C 5/12; E01C 5/08; E01C 5/122; E01D 19/14
USPC ..... 52/223.1, 223.11, 223.12, 223.13, 52/223.14, 223.2, 223.3, 223.4, 223.5, 52/223.6, 223.7, 223.8, 223.9; 277/650, 277/651, 652, 653, 654; 14/18, 21, 22–24
See application file for complete search history.

(56) References Cited

U.S. PATENT DOCUMENTS 2,755,657 A * 7/1956 Finsterwalder ..... 52/223.13
3,351,320 A * 11/1967 Harvey ..... 254/29 A (Continued)

FOREIGN PATENT DOCUMENTS

DK 161604 B * 7/1991
EP 323285 A * 7/1989

(Continued)

OTHER PUBLICATIONS

International Search Report for PCT/EP2010/053975 dated Feb. 14, 2011.

*Primary Examiner* — Charles A. Fox
*Assistant Examiner* — Joseph J Sadlon
(74) *Attorney, Agent, or Firm* — Pearne & Gordon LLP

(57) ABSTRACT

The present invention relates to a sealing arrangement (202) for a building element comprising tension members. The sealing arrangement (202) is arranged to seal off an internal part of the building element. The sealing arrangement (202) comprises: (a) a first pressing element (500) of rigid material; (b) a transition pad (501) of deformable material; (c) a sealing pad (503) of elastic material; and (d) a second pressing element (505; 507) comprising a rigid layer (507) for pressing the transition pad (501) and the sealing pad (503) against the first pressing element (500). The transition pad (501), the sealing pad (503) and the second pressing element (505; 507) are provided with holes for the tension elements to pass through. When operationally in place, the first pressing element (500), the transition pad (501), the sealing pad (503) and the second pressing element (505; 507) are pressed together.

20 Claims, 5 Drawing Sheets

(56) References Cited

U.S. PATENT DOCUMENTS

| | | | | | |
|---|---|---|---|---|---|
| 3,437,359 | A * | 4/1969 | Hunter | 24/115 R | |
| 3,787,957 | A * | 1/1974 | Andrews | 29/452 | |
| 4,237,942 | A * | 12/1980 | Dietrich | 140/105 | |
| 4,505,081 | A * | 3/1985 | Dinis et al. | 52/223.14 | |
| 4,671,034 | A * | 6/1987 | Rehm et al. | 52/223.13 | |
| 5,197,157 | A * | 3/1993 | De La Fuente | 14/18 | |
| 5,809,710 | A * | 9/1998 | Jungwirth et al. | 52/223.1 | |
| 6,105,973 | A * | 8/2000 | Butler et al. | 277/644 | |
| 7,174,684 | B2 * | 2/2007 | Nuetzel et al. | 52/223.13 | |
| 7,181,890 | B2 * | 2/2007 | Nuetzel | 52/223.13 | |

FOREIGN PATENT DOCUMENTS

| | | | | |
|---|---|---|---|---|
| EP | 0437143 | | 7/1991 | |
| EP | 0437143 | A1 | 7/1991 | |
| EP | 1435413 | A1 * | 7/2004 | E01D 19/14 |
| FR | 2806107 | | 9/2001 | |
| FR | 2806428 | A1 * | 9/2001 | E01D 19/14 |
| FR | 2806107 | A1 | 9/2009 | |
| GB | 2148351 | A | 5/1985 | |
| WO | 03083216 | A1 | 10/2003 | |

* cited by examiner

SEALING ARRANGEMENT

TECHNICAL FIELD

The invention relates to a new structure for a sealing arrangement to be used for instance in bridge saddles or bridge anchoring devices. The invention likewise relates to a corresponding building element, such as a bridge saddle or a bridge anchoring device, comprising the sealing arrangement.

BACKGROUND OF THE INVENTION

The invention applies more specifically, but not exclusively, to elements comprising tension members, such as metal strands of cables which, made up of a multiplicity of strands, are used in civil engineering and building activities.

Numerous structures and notably bridges comprise cables which are used in particular to support elements of these structures. Such cables are stressed in traction between their opposite ends by use of anchoring devices, which are used for fixing a structural cable to a building element. Frequently saddles, also known as guiding devices, are used for holding cables in such a manner as to deviate them in whatever way in the direction in which they must extend.

The function of a saddle of the type cited above is thus to permit lateral and/or longitudinal and local holding of a cable and transfer of the stress caused by this deviation to a support, such as a bridge pylon, provided for this purpose. A saddle of the aforementioned type is intended to be interposed between the support and the cable such as inside a pylon for stay cables or a bridge girder diaphragm for external tendons. Conventional saddles used one simple steel pipe for all strands, i.e. the bundle of strands placed inside one common pipe. In some solutions individual steel tubes were provided for the strands. More recently, saddles with holes or channels (obtained by so-called void formers which are removed after the grouting) for each individual strand were developed. In some solutions these holes have a V shape to improve the clamping effect. Saddles with individual tubes or channels are conceived to allow individual local support of each strand of a cable.

To this end, a recent saddle comprises at least one bearing area for guiding a strand of a cable, and preferably a plurality of bearing areas for deviation, each permitting the individual support of one of the strands of a cable.

Inside bridge anchoring devices and bridge saddles, the strands are often unsheathed to increase friction between the strands and some parts of the saddle or the anchoring device or to permit anchorage by wedging in the anchoring device. The increased friction helps to keep the strands in place in the anchoring device or in the saddle. However, the unsheathed strands are prone to corrosion, and for this reason the saddles and the anchoring devices need to be properly sealed off from the outside environment. In the context of this patent application, the term corrosion is used to mean any process, for example chemical or electrolytic, which can have a deleterious effect on the chemical integrity, and hence the mechanical properties, of the strands.

Another issue that needs to be taken into account is the fact that bridge structural cables, such as stay cables, are often exposed to strong winds. The exposure to wind creates forces on, and movements of, cables that are transferred to the rest of the structure. The problem is thus how to cope with cable deviation due to transverse load at the entrance of the saddle or anchoring device, and how to overcome cyclic loading due to vibrations which may damage the cable or the structure.

It is the aim of the present invention to provide an improved sealing arrangement to be used in bridge saddles and/or anchoring devices so that the shortcomings of the prior art can be overcome.

SUMMARY OF THE INVENTION

According to a first aspect of the invention, a sealing arrangement for a building element comprising tension members is provided, the sealing arrangement being arranged to seal off an internal part of the building element, the sealing arrangement comprising:

a transition pad of deformable material;

a sealing pad of elastic material; and a pressing element comprising a rigid layer, wherein the transition pad, the sealing pad and the pressing element are provided with holes for the tension members to pass through, and wherein the transition pad, the sealing pad and the pressing element are pressed together.

The proposed arrangement offers several advantages. For instance, the present sealing arrangement can be used in both bridge saddles and bridge anchoring devices, and it can be easily installed and removed. The proposed solution provides a very good sealing effect, ensuring that no moisture can penetrate into the saddle or anchoring device. Furthermore, the present sealing arrangement also dampens the transverse movements of the tension members, thereby ensuring that the wind forces are transferred to a structural element designed to take the force, and thus protecting the saddle or anchoring device structure itself and thus avoiding any damage to the strand.

The sealing arrangement permits to inject the inside of the saddle with protective material such as grease, wax, or gel-based material which is not hardening. Hence, the proposed solution allows individual replacement of the strands.

According to a second aspect of the invention, a building element comprising the sealing arrangement according to the first aspect is provided, wherein the building element comprises a body with an open end, the sealing arrangement being installed at the open end of the body, the pressing element being closest to the body, and wherein the body comprises an injection chamber for receiving corrosion protection material injected into the chamber through an injection tube passing through the transition pad, the sealing pad and the pressing element.

Other aspects of the invention are recited in the dependent claims attached hereto.

BRIEF DESCRIPTION OF THE DRAWINGS

Other features and advantages of the invention will become apparent from the following description of a non-limiting exemplary embodiment, with reference to the appended drawings, in which.

DETAILED DESCRIPTION OF AN EMBODIMENT OF THE INVENTION

An embodiment of the present invention will be described in the following in more detail with reference to the attached figures. In said embodiment, the sealing arrangement is provided in the bridge saddle, but it is to be noted that the sealing arrangement in accordance with the present invention can be likewise applied to a bridge anchoring device or to external tendon deviation devices inside a bridge deck for instance.

Figure 1:
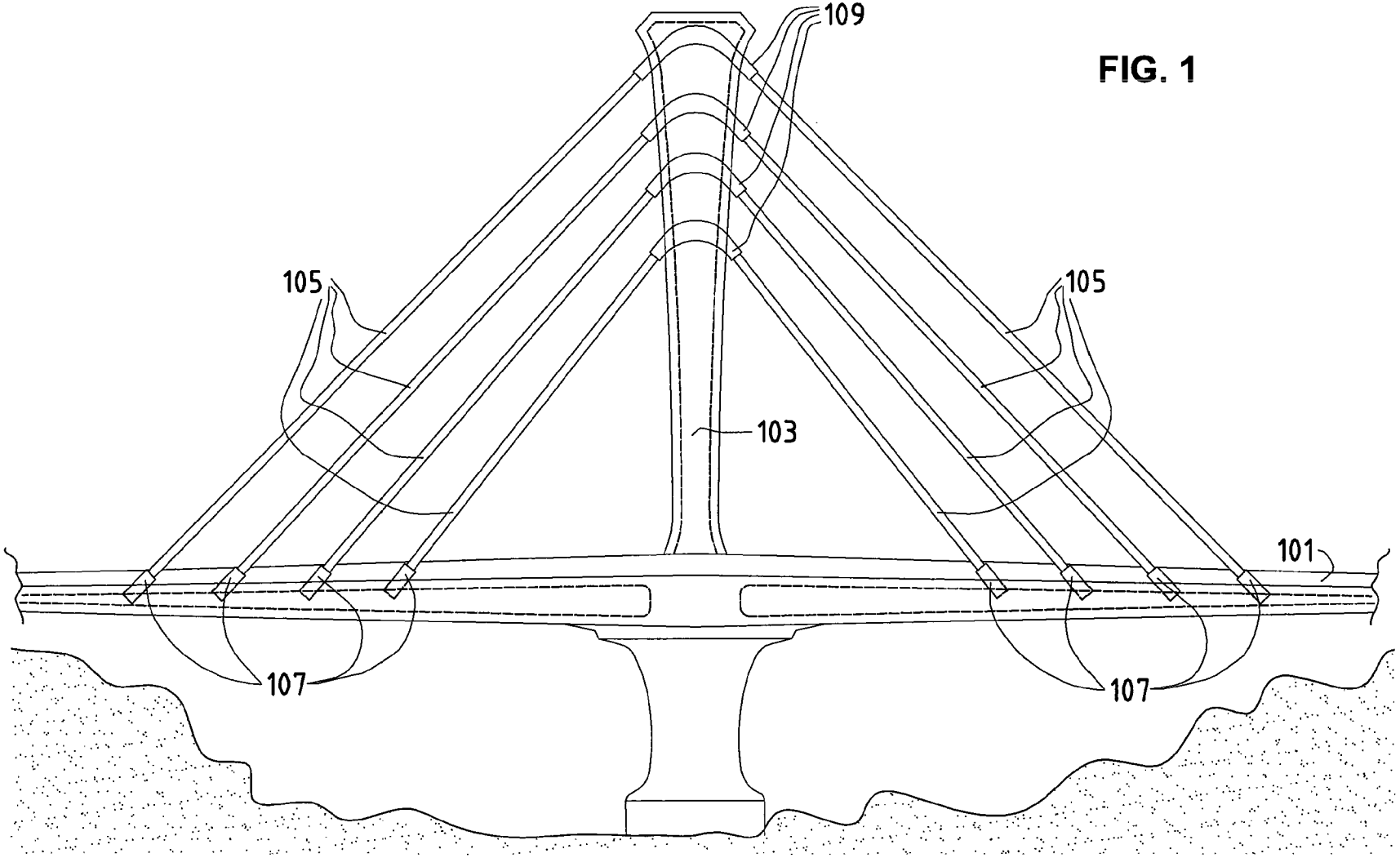
FIG. 1 is a simplified side view of a cable-stayed bridge showing bridge saddles.

FIG. 1 shows a cable-stayed bridge where the teachings of the present invention in accordance with the present invention can be applied. A cable-stayed bridge generally includes:

- a deck 101, which includes a structural member, for example a concrete or metallic structural member, with, also for example, at least one internal chamber (however, could also be an open cross deck cross section),
- at least one pylon 103, the pylon 103 including at least one substantially upright element, each pylon 103 including namely a first part, which extends under the deck, and a second part, which extends above the deck,
- a multiplicity of stay cables 105.

Each stay cable 105 extends between two deck anchorages 107, situated on the deck 101, in such a way that each stay cable 105 traverses a strand guiding device 109, hereinafter referred to as a bride saddle, situated in the upper part of the pylon 103.

It is to be noted that in some solutions the saddles 109 are replaced with anchoring devices 107, so that both the bridge deck 101 and the pylons 103 comprise anchoring devices 107. If the latter solution is used, this means that the cable 105 in fact becomes two separate cables, each one extending between the deck and the pylon.

The stay cable elements used in the field of construction of cable-stayed or suspension bridges are generally corrosion-protected (for years) by a layer of protective material which can be grease, wax or gel-based, and a sheath surrounding the protective layer. However, the presence of the protecting layer and of the sheath increases the diameter of the strand.

Conventionally, the strands are each made up of a multiplicity of wires, generally metallic, but not limited thereto. For example, in some solutions each strand comprises a group of seven wires with a cross section which is inscribed in a circle. Each cable 105 usually comprises a plurality of strands.

Figure 2:
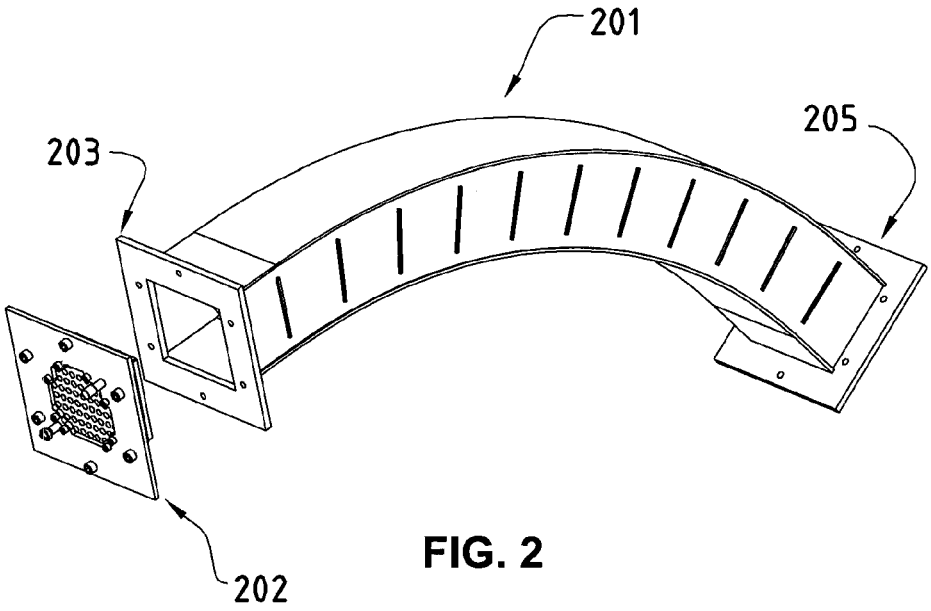
FIG. 2 shows in a perspective view a saddle body together with the sealing arrangement in accordance with an embodiment of the present invention.

FIG. 2 shows a perspective view of a body 201 of a saddle 109 together with a sealing arrangement or sealing means 202 (not operationally in place in FIG. 2). The saddle is arranged to be traversed longitudinally (following the longitudinal axis of the body) by strands of a stay cable 105. Designated by longitudinal axis is a curved path which extends along the longitudinal dimension of the body 201, but not necessarily in the middle position with respect to the outer dimensions of the saddle body 201. It is to be noted that the bridge anchoring devices 107 are by similar fashion arranged to be traversed by cable strands, so that at one end the strands are anchored.

In this example, the body 201 is a curved rectangular steel box that has a first open end 203 and a second open end 205. The cross section of the body 201 could of course be round or shaped in other form to enclose the bundle of strands.

Figure 3:
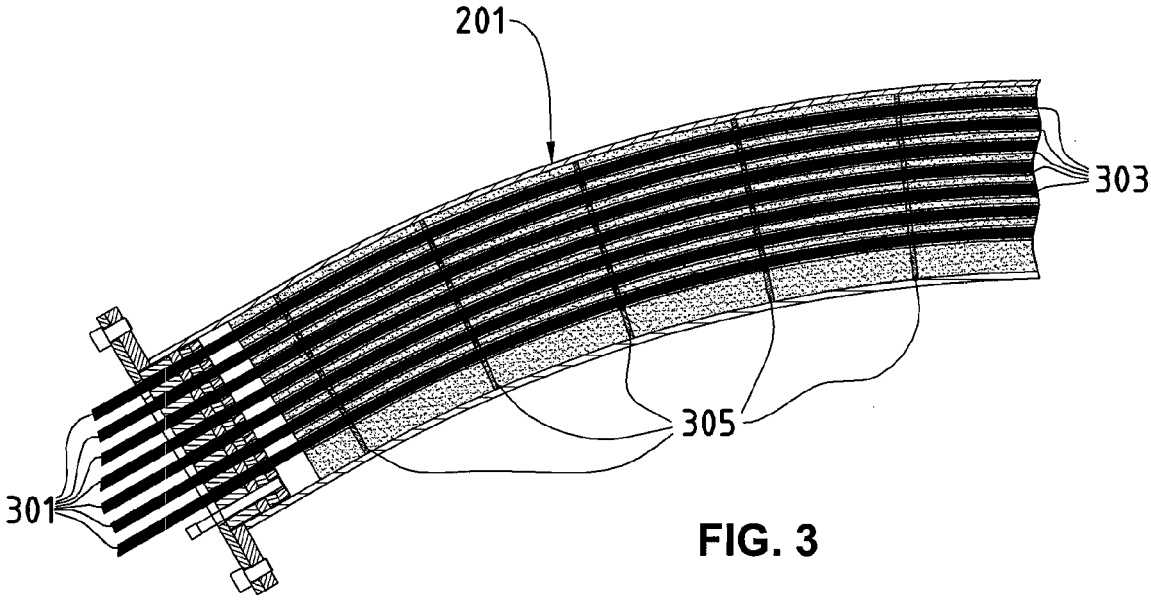
FIG. 3 is a cut side view showing part of the saddle, with strands in place, seen in section along a longitudinal plane.

FIG. 3 illustrates a side view of one part of the body 201 in the longitudinal plane. In this specific example, the side view of the saddle body 201 shows seven strands 301. Also shown are channels 303, in this example steel tubes (aluminium or plastic tubes are also possible), one tube 303 being provided for each strand 301, and the strands 301 being arranged to traverse the tubes 303 longitudinally. Each tube 303 of the body comprises a curved so longitudinal axis and at least one first part which, situated in principle at the side of the intrados of the longitudinal axis, permits, within the limit of the length of the tube, the support of the strand 301 on a portion of the peripheral face of the strand 301. The tubes 303 follow the curvature of the saddle body 201. In this figure the sealing arrangement 202 is in place so that the interior part of the body 201 can be sealed off from the outside environment.

Tube supporting elements 305 are also provided to support the tubes 303 and hold them in place inside the saddle body 201. The purpose of the supporting elements 305 is also to support the void formers (in the solution where these are needed) and to take some transverse forces caused by the deviation forces of the curved and stressed strands. These supporting elements 305 are arranged to be approximately perpendicular with respect to the tubes 303.

In this specific example, the part of the strands 301 traversing the tube or channel 303 is not sheathed (the strands being initially sheathed, but the sheath is removed in the region of the saddle or anchoring device as part of the installation process) to increase the friction between the strand 301 and the tube 303 or to permit anchorage by a wedge. This has the advantageous effect of holding the strand 301 in place even when under significant differential tension between the first end 203 and the second end 205. However, the unsheathed strands are susceptible to corrosion, and for this reason protective material may be provided in the saddle body 201 (as will be explained later in more detail) to prevent corrosion from occurring. The protective material may be polymeric, wax, grease or gel-based. Furthermore, the part of the strand 301 that is not inside the tube 303 is sheathed to provide protection, e.g. against corrosion. The sheathing can be made of polyethylene material, for example. The space between the individual tubes is advantageously filled with a hardening material such as cementitious mortar.

Different shapes of the tube cross sections have different clamping effects. For instance, by using V-shaped cross sections at the side of the intrados, a relatively high clamping effect can be obtained. In this case the cross sections of the tube 303 and strand 301 are not of complementary shape.

However, in traditional solutions the tubes 303 each have a cross section of substantially complementary shape to that of the strand 301 which they receive. For example, when the strands 301 of the cable 105 each have a cross section which inscribes a circle, each tube 303 has a cross section substantially circular of an internal diameter greater than the circle in which the cross section of a strand 301 is inscribed in order to facilitate the insertion of the strand 301 through the tube 303.

In the above illustrated solution the space between the individual tubes is grouted. In another solution (not illustrated in the figures), channels are formed inside the saddle body 201 by void formers which are removed after the filler around has hardened. Also in this solution the channels can have a V shape to improve the clamping effect. In this solution the absence of the metal tubes 303 is even advantageous in the sense that the strands 301 would then not be in contact with metal tubes 303 prone to corrosion or where the contact to metal could cause fretting fatigue to the strand.

The sealing arrangement 202 in accordance with the present invention allows injecting into the saddle body 201 protective material for protecting the strands 301 and/or the tubes 303 from corrosion. As stated above, the injected protective material can be polymeric material, wax, grease or gel-based, or other similar material, as long this filler keeps oxygen and moisture out of the saddle body 201 and allows removal of the strands 301. For instance, the polymeric material is obtained by mixing two types of liquids, enabling the polymerisation process to take place. The obtained polymeric material is water repellent (does not mix with water), and is only little permeable to gases. The injection is advantageously done after mixing of the liquids, before the solidifying (polymerisation) process has properly started. After mixing and injection, the obtained mixture will become solid, but will not harden and thus remains flexible, soft and elastic. Once solidified, the protective filler sticks well to metal surfaces.

The bridge saddles 109 are often located high above the ground level and for this reason a special arrangement for the injection is needed, as explained below.

Figure 4:
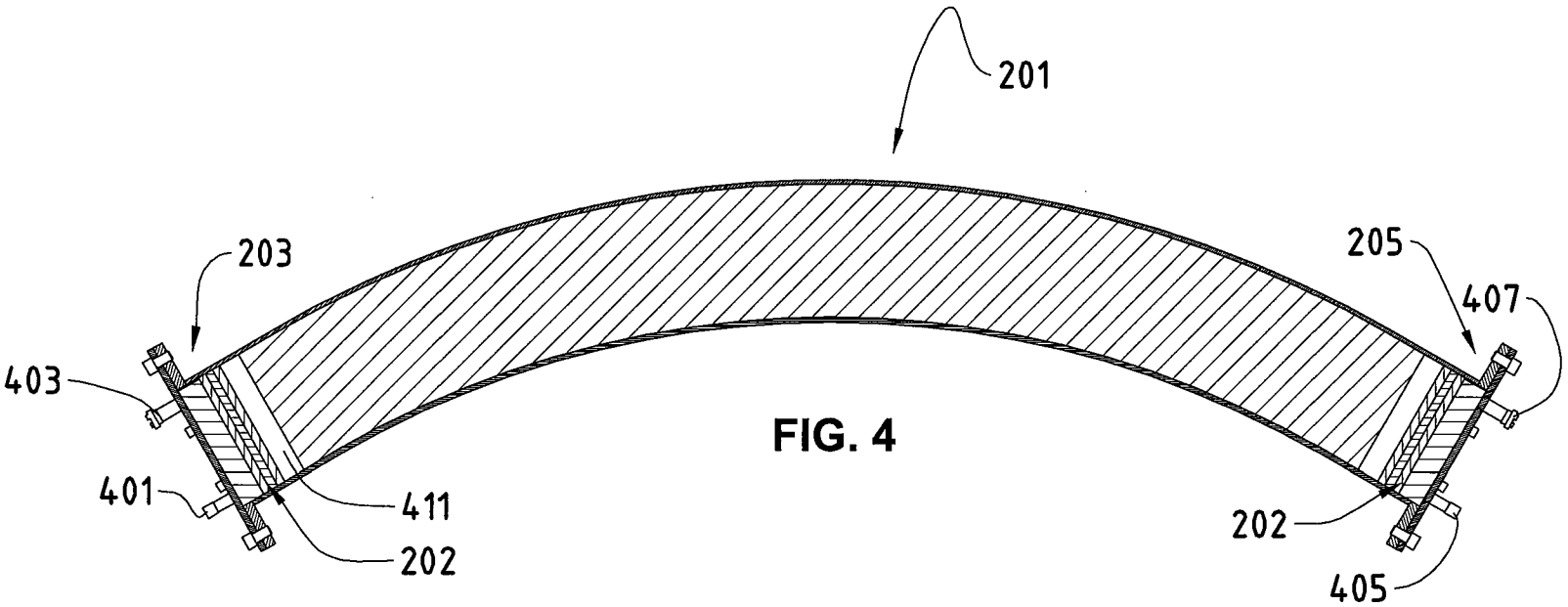
FIG. 4 is a cut side view of the saddle, including sealing means, seen in section along a longitudinal plane.

Referring now to FIG. 4, the protective material is advantageously injected into the saddle body 201 through one of the injection tubes 401; 405 located at both ends, at the bottom of the body 201. The injection tubes pass through the sealing arrangement 202. In this example, there are two injection tubes so that the injection is done through one of the injection tubes 401; 405, but it would be also possible to use both injection tubes simultaneously. The injection tubes 401; 405 are connected to a filling tank (not shown).

At the upper part of both ends of the saddle body 201 there are shown a first vent 403 and a second vent 407, one of them connected to a vacuum pump (not shown). Usually only one vent is used at a time so that the purpose of the vent is to allow air to escape during injection. To improve the filling of the interior of the saddle body 201, the air is first sucked away from the saddle body 201 through one of the vents 403; 407 by using the vacuum pump. This has the effect that all the voids in the interior of the saddle body can be filled with the protective material. In the case where the interior of the saddle body is grouted, then the protective material would fill the space between the strand 301 and the channel wall. The benefit of doing the injection from below and sucking the air from above is that the air can be better removed from the saddle body 201. Usually the air is sucked from the end opposite to the end of injection to improve the filling. Of course it is possible to do these operations at the same end.

The protective material injection is done once all the strands 301 (not shown in FIG. 4) are in place inside the saddle body 201 and stressed. To facilitate the filling with protective material, the protective material is first injected through one of the injection tubes 401; 405 into a filling chamber 411. From the filling chamber 411 the protective material spreads all around the interior of the saddle body 201 assisted by vacuum application into all individual tubes, and then, some time after completion of injection, it starts solidifying. The injection is stopped once the injected material starts to run out of the saddle body through the vent located at the opposite end.

Figure 5:
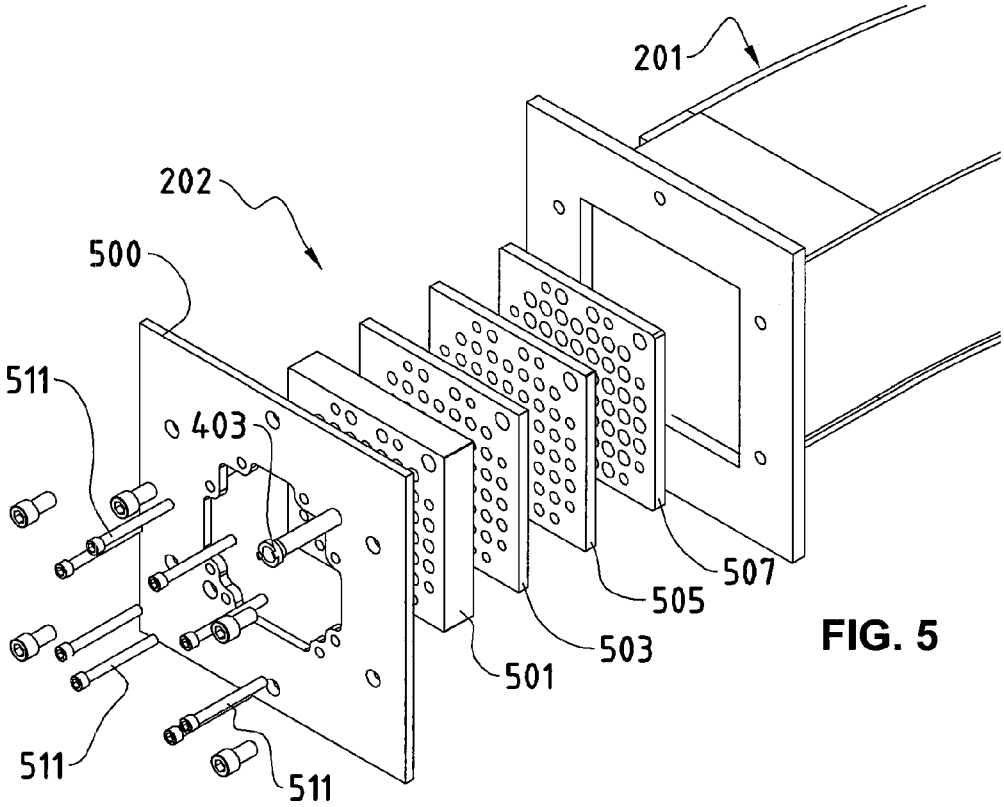
FIG. 5 illustrates the sealing arrangement for the saddle in accordance with an embodiment of the present invention.
Figure 6:
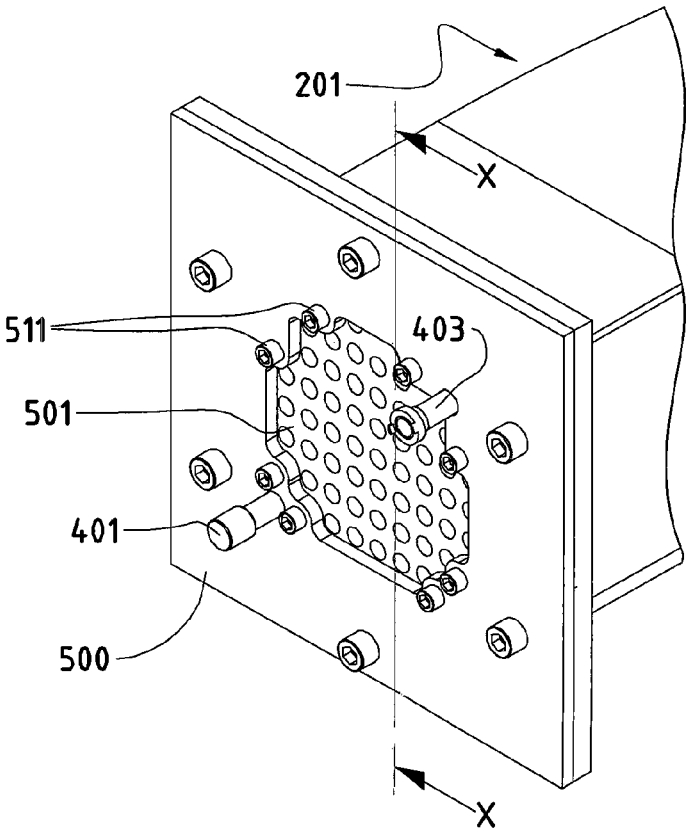
FIG. 6 illustrates the sealing arrangement of FIG. 5 when in place in the saddle.
Figure 7:
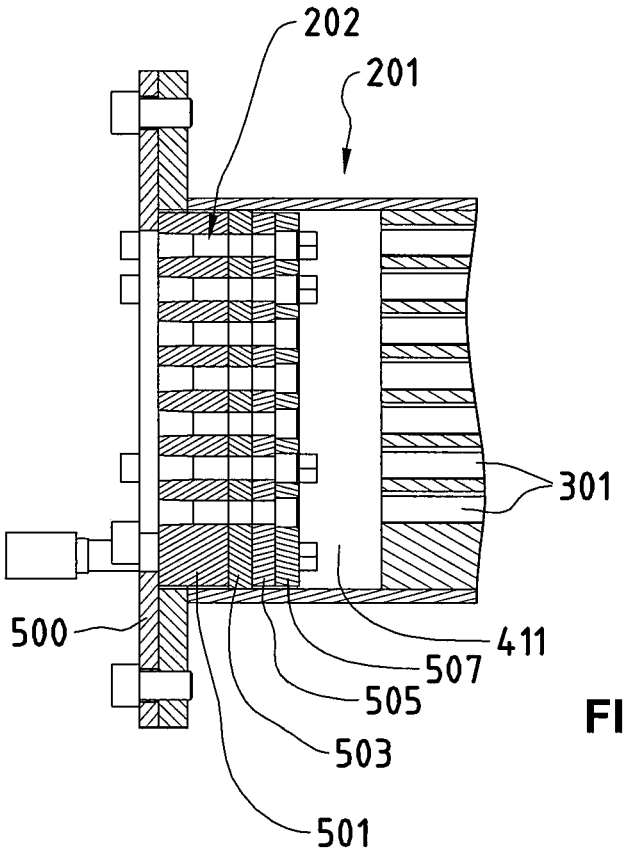
FIG. 7 is a cut view showing the sealing arrangement of FIG. 5 along the line X-X of FIG. 6.

The sealing arrangement 202, described in more detail with reference to FIGS. 5-7, is provided on both ends of the saddle body 201.

The sealing arrangement 202 comprises several flat elements, in this example five elements: the outermost element from the body 201 is a front pressing plate 500, the next element being a transition pad 501, the next element being a sealing pad 503, the following being a pressing pad 505, and the element closest to the body 201 is a rear pressing plate 507. The pressing pad 505 and the rear pressing plate 507 together can be referred to as a rear pressing element. Holes are provided in the transition pad 501, the sealing pad 503, the pressing pad 505 and the rear pressing plate 507 for the strands 301 to pass through. The shape of the holes is advantageously complementary to the shape of the strands 301 that pass through these holes to guarantee a good sealing effect. Therefore, the sealing arrangement 202 advantageously makes leak tightness around the strands 301 when the strands 301 traverse the sealing arrangement 202.

The front pressing element 500 is a rigid element, and in this example it is a steel plate. In the example shown in the figures, there are no holes in the front pressing plate 500 for the strands to pass through to prevent any contact of steel strand to steel plate, but a solution with holes for the strands 301 is also possible. However, holes are provided for tightening means to pass through for pressing the transition pad 501, the sealing pad 503, the rear pressing pad 505 and the rear pressing plate 507 against the front pressing plate 500.

The transition pad 501 is deformable, and can be made of polyethylene, for instance, and its primary function is to take transverse deviation forces from the strands and to dampen the movements of the strands 301, but its function is also to seal and protect. When considered in the direction of the holes passing through the elements, the width of the transition pad 501 is larger than the width of the other elements of the sealing arrangement 202. The width of the transition pad 501 can be two or three times the width of the sealing pad 503, for instance. This has the advantageous effect of resisting relatively large deviation forces and of dampening relatively strong strand 301 movements.

As can be seen in FIG. 7, the holes that pass through the transition pad 501, the sealing pad 503, the pressing pad 505 and the pressing plate 507 have a chamfered end where the transition pad 501 is pressed against the front pressing plate 500. The chamfer angle can be a few degrees, e.g. 2 degrees. This further facilitates the movements of the strands 301 without bearing against a sharp edge. The chamfer angle is also useful if the strands 301 are deviated intentionally. When the strands 301 move due to loads on the cable, the transition pad 501 may undergo elastic deformation. This type of deformation is reversible. In other words, once the forces are no longer applied, the transition pad 501 returns to its original shape. Thus, it provides a smooth transition zone for the strands 301 that traverse the sealing arrangement 202 without creating a hard spot which could damage the strand.

The primary function of the non-rigid sealing pad 503 is to seal the interior of the saddle body 201 from the outside environment. This pad ensures that the moisture from the outside of the saddle body 201 cannot penetrate into the interior part of the body 201, and it is also intended to prevent the injected protective material from flowing away from the body 201. The sealing pad 503 can be made of neoprene, for instance, such as ethylene propylene diene monomer rubber. The actual sealing is made by compression of the sealing pad 503 between the transition pad 501 and the pressing pad 505, both advantageously made of polyethylene.

The rigid pressing pad 505, made for instance of polyethylene or polypropylene, is used together with the rigid steel rear pressing plate 507 to compress the transition pad 501 and the sealing pad 503 against the front pressing plate 500. For this purpose screws 511 or corresponding tightening means are provided to provide sufficient compression. The pressing pad 505 and the rear pressing plate 507 also act as a spacer for the strands 301.

When installing the saddle 201 and the strands 301, the following steps are performed: The saddle 109 is first installed onto a bridge pylon 103 with sealing 202 pre-installed but not tightened. The strands 301 are then threaded through the saddle body 201. After this, the strands 301 can be stressed, and the transition pad 501 and the sealing pad 503 are compressed between the front pressing plate 500 and the rear pressing element. Then the protective material can be injected into the saddle body 201.

As explained earlier, the teachings of the present invention are equally applicable to anchoring devices or deviators for external tendons in a bridge deck.

While the invention has been illustrated and described in detail in the drawings and foregoing description, such illustration and description are to be considered illustrative or exemplary and not restrictive, the invention being not limited to the disclosed embodiment. Other embodiments and variants are understood, and can be achieved by those skilled in the art when carrying out the claimed invention, based on a study of the drawings, the disclosure and the appended claims.

In the claims, the word "comprising" does not exclude other elements or steps, and the indefinite article "a" or "an" does not exclude a plurality. A single processor or other unit may fulfil the functions of several items recited in the claims. The mere fact that different features are recited in mutually different dependent claims does not indicate that a combination of these features cannot be advantageously used. Any reference signs in the claims should not be construed as limiting the scope of the invention.

The invention claimed is:

1. A sealing arrangement for a building element comprising tension members, the sealing arrangement being arranged to seal off an internal part of the building element, the sealing arrangement comprising:

a transition pad of deformable plastic material;

a sealing pad of elastic material; and a pressing element comprising a rigid layer, wherein the transition pad, the sealing pad and the pressing element are provided with holes for the tension members to pass through, wherein said sealing pad is in contact with the transition pad on one side and the pressing element on another side and wherein the sealing pad and the pressing element are pressed together, wherein the transition pad is pressed to the sealing pad and the pressing element, the transition pad being constructed and arranged so as to support deviation forces, to dampen movements of the tension members, to seal and to protect the tension members.

2. The sealing arrangement according to claim 1, wherein the pressing element comprises a pressing pad of rigid material and a pressing plate of rigid material.

3. The sealing arrangement according to claim 2, wherein the pressing pad is made of polyethylene or polypropylene and the pressing plate is made of steel.

4. The sealing arrangement according to claim 1, further comprising another pressing element pressed against the transition pad.

5. The sealing arrangement according to claim 4, wherein the other pressing element is a flat plate made of steel.

6. The sealing arrangement according to claim 1, wherein the building element is a bridge anchoring device or a bridge saddle.

7. The sealing arrangement according to claim 1, wherein the transition pad is made of polyethylene or polypropylene.

8. The sealing arrangement according to claim 1, wherein at least one of the holes of the transition pad has a chamfered end.

9. The sealing arrangement according to claim 1, wherein the sealing pad is made of neoprene.

10. The sealing arrangement according to claim 9, wherein the neoprene is ethylene propylene diene monomer rubber.

11. The sealing arrangement according to claim 1, further comprising at least one injection tube passing through the transition pad, the sealing pad and the pressing element for injecting corrosion protection material into the building element.

12. The sealing arrangement according to claim 1, further comprising at least one vent passing through the transition pad, the sealing pad and the pressing element for sucking air from the building element and for venting filler during injection.

13. The building element comprising the sealing arrangement according to claim 1, wherein the building element comprises a body with an open end, the sealing arrangement being installed at the open end of the body, the pressing element being closest to the body, and wherein the body comprises an injection chamber for receiving corrosion protection material injected into the chamber through an injection tube passing through the transition pad, the sealing pad and the pressing element.

14. The sealing arrangement of claim 1 comprising fasteners that press the transition pad, the sealing pad and the pressing element together.

15. A building element comprising:

a hollow elongated body having an open end and including a plurality of cable strands extending in an internal part of said body past said open end; and a sealing arrangement installed at the open end of said body to seal off the internal part of said body, the sealing arrangement comprising:

a rigid front pressing plate disposed outside of said body;

a transition pad of deformable plastic material in contact with said front pressing plate;

a sealing pad of elastic material in contact with said transition pad; and a pressing element comprising a rigid inner plate and a plastic pressing pad, said plastic pressing pad being disposed between and in contact with said sealing pad and said inner plate, wherein said sealing pad is in contact with said transition pad on one side and said plastic pressing pad on another side, wherein said transition pad, said sealing pad and said pressing element are formed with holes for the cable strands to pass through;

fasteners extending between said front pressing plate and said inner plate;

wherein said transition pad and said sealing pad are compressed between said front pressing plate and said inner plate by tightening said fasteners, whereby said sealing pad seals the internal part of said body and said transition pad supports deviation forces, dampens movements of said cable strands, seals and protects said cable strands.

16. The building element according to claim 15, wherein the building element is a bridge anchoring device or a bridge saddle.

17. The building element according to claim 15 wherein said holes in said transition pad are formed with chamfers adjacent said front pressing plate.

18. The building element according to claim 15 wherein said front pressing plate and said inner plate are made of steel.

19. The building element of claim 18 wherein said sealing pad is made of rubber.

20. The building element of claim 15 wherein said sealing pad is made of rubber and said front pressing plate and said inner plate are made of steel.

* * * * *